United States Patent [19]

Henson

[11] 3,951,118

[45] Apr. 20, 1976

[54] ENGINE TIMING DEVICE

[75] Inventor: Ralph B. Henson, Creve Coeur, Ill.

[73] Assignee: Caterpillar Tractor Co., Peoria, Ill.

[22] Filed: Dec. 19, 1974

[21] Appl. No.: 534,251

[52] U.S. Cl. ..... 123/139 AP; 64/24; 64/25; 403/359

[51] Int. Cl.[2] ..... F02M 39/00

[58] Field of Search ..... 123/139 AP; 64/24, 25; 403/359

[56] References Cited

UNITED STATES PATENTS

| | | | |
|---|---|---|---|
| 3,478,542 | 11/1969 | Dinger | 64/24 |
| 3,683,879 | 8/1972 | Timms | 123/139 AP |
| 3,834,184 | 9/1974 | Hofman | 64/25 |

FOREIGN PATENTS OR APPLICATIONS

| | | | |
|---|---|---|---|
| 759,744 | 2/1934 | France | 123/139 AP |
| 894,273 | 5/1943 | France | 123/139 AP |
| 1,055,012 | 4/1952 | France | 123/139 AP |

*Primary Examiner*—Charles J. Myhre
*Assistant Examiner*—Ronald B. Cox
*Attorney, Agent, or Firm*—John W. Grant

[57] ABSTRACT

An engine timing device for adjusting the relative angularity between drive gear and a fuel pump actuating shaft including a coupling member slidably, drivingly connected to a driving member and a driven member operatively associated with the drive gear and fuel pump actuating shaft, respectively, a helical connection linking the coupling member with one of the driving or driven members and an actuating device rotatably mounted on the coupling member and engagable with a housing selectively to move the coupling member axially relative to the one member for adjusting the angular position of the driven member relative to the driving member while the engine is running.

2 Claims, 4 Drawing Figures

ENGINE TIMING DEVICE

BACKGROUND OF THE INVENTION

Compression ignition engines commonly have a timing mechanism to time the injection of fuel into the combustion chambers in response to engine speed for improving the efficiency and economy of the engine. Also, proper timing is critical for reducing the emission of noxious matter and excessive cylinder pressures. Such timing mechanism usually includes a system for interconnecting a pair of shafts so that their angular relationship can be varied in response to the movement of a pair of centrifugally actuated flyweights. While such timing mechanism effectively varies engine timing over the selected speed range in response to engine speed, the initial or static position of the shafts is set with the engine stopped because of the relatively high torque generated in the pump shaft due to the inherently high fluid pressure created by the fuel injection pumps. Heretofore the static positioning of the shafts has been dependent upon the proper alignment of timing marks on the gears of the timing gear train. However, setting the timing by the use of such timing marks does not compensate for the build up of manufacturing tolerances or the normal backlash in the gear train. Furthermore, such timing mechanism has the undesirable characteristic that even though the fuel pump shaft is advanced with increased engine speed, frequently the timing is retarded or backed down toward the initial setting by the pump force and resulting torque action on the timing mechanism.

OBJECTS OF THE INVENTION

Accordingly, an object of this invention is to provide an improved engine timing device which provides a manual adjustment for setting the static timing of the engine.

Another object of this invention is to provide such an improved engine timing device which includes an automatic timing mechanism in combination with the manual adjustment which permits manual setting of the static timing independently of and without effecting the setting of the automatic timing mechanism.

Another object of this invention is to provide an engine timing device of the character described which permits the static engine timing to be readily and accurately adjusted with the engine running to eliminate timing error due to tolerance build up and timing gear backlash.

Another object of this invention is to provide an engine timing device having an automatic timing mechanism which is not moved toward the retarded position by reverse torque applied to the timing mechanism by the fuel pump shaft.

Other objects and advantages of the present invention will become more readily apparent upon reference to the accompanying drawings and following description.

DESCRIPTION OF THE PREFERRED EMBODIMENT

Figure 1:
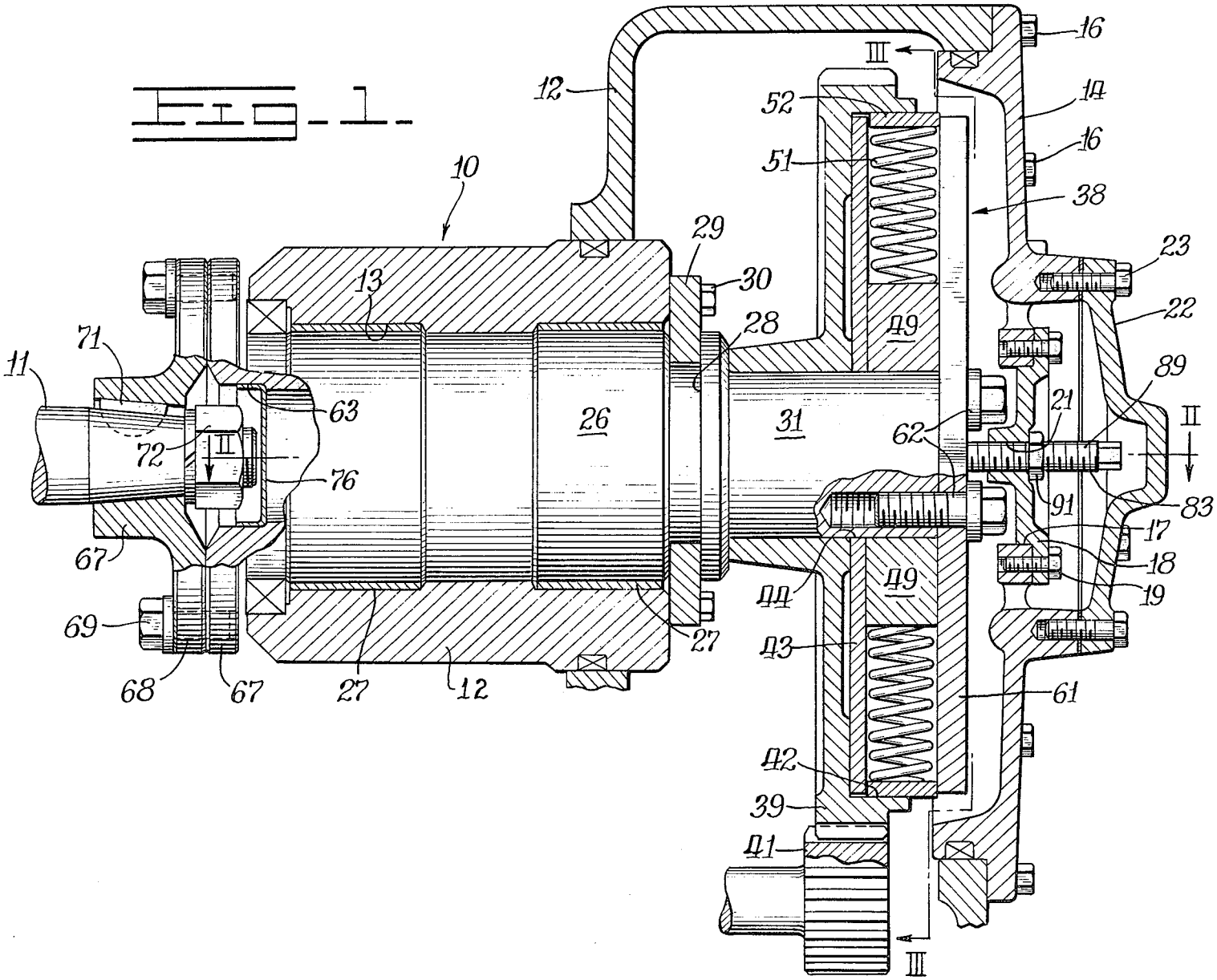
FIG. 1 is a cross sectional view taken through an engine timing device embodying the principles of the present invention.
Figure 2:
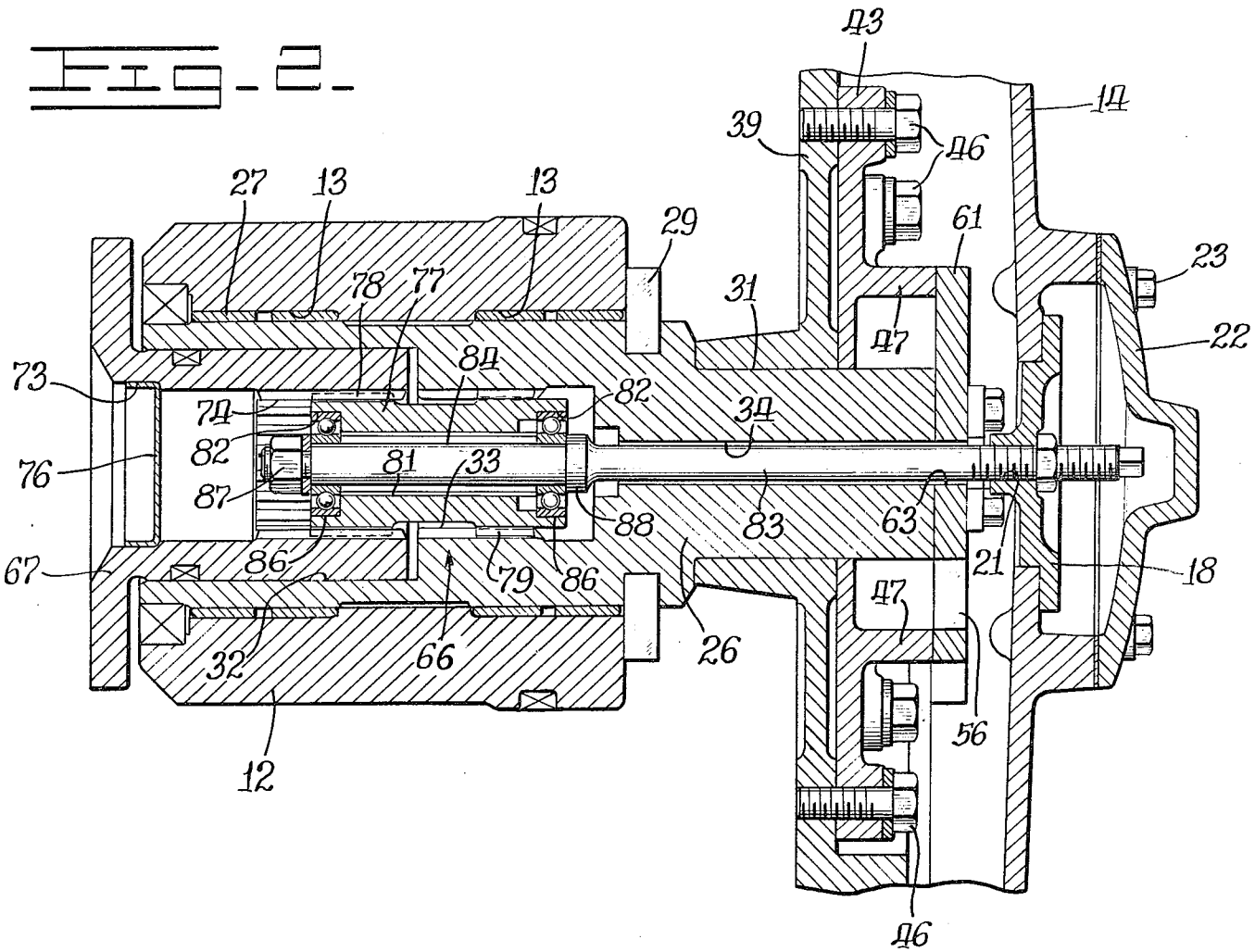
FIG. 2 is a sectional view of the engine timing device taken along line II—II of FIG. 1.

Referring more particularly to the drawings, an engine timing device embodying the principles of the present invention is generally indicated by the reference numeral 10 for driving a fuel pump shaft 11. The engine timing device is contained within a housing 12 having a bore 13 formed therein. A mounting plate 14 is fastened to the housing by a plurality of bolts 16 and is provided with a centrally disposed opening 17 which is covered by an adapter 18 fastened to the mounting plate by a plurality of bolts 19. A threaded bore 21 is provided in the adapter. An access cover 22 is removably fastened to the mounting plate by a plurality of bolts 23.

A tubular shaft 26 is rotatably supported by a pair of bearings 27 disposed within the bore 13 of the housing 12. An annular groove 28 is formed in the shaft intermediate its ends and receives a thrust member 29 which is secured to the housing by a pair of bolts one of which is shown at 30 to axially position the shaft. A reduced diameter portion 31 is formed on the shaft at an end adjacent to the adapter 18. A plurality of axially extending concentric bores 32, 33, and 34 are formed in the shaft.

The engine timing device 10 includes an automatic timing mechanism 38 which includes a gear 39 rotatably mounted on the reduced diameter portion 31 of the shaft 26 to permit relative angular movement therebetween. The gear is driven by a drive gear 41 operatively driven by a crank shaft, not shown, and has an annular recess 42 formed therein opening towards the mounting plate 14. An elongated plate 43 is seated within the recess and has a centrally disposed opening 44 formed therethrough to receive the reduced diameter portion. The plate 43 is secured to the gear 39 by a plurality of bolts 46. A pair of parallel projections 47 are formed on the plate 43 and extend toward the mounting plate forming a transversely disposed guide slot 48. A pair of flyweights 49 are slidably disposed in the guide slot on opposite sides of the shaft. Each flyweight is resiliently urged toward the shaft by a pair of springs 51 disposed between the flyweight and an annular shaped spring retainer 52 which is in abutment with the recess. The springs are individually seated within a pair of bores 53 formed in each flyweight. A driving pin 54 is secured to and extends outwardly from each flyweight. A slider block 56 is rotatably fastened to each pin by a snap ring 57.

Figure 4:
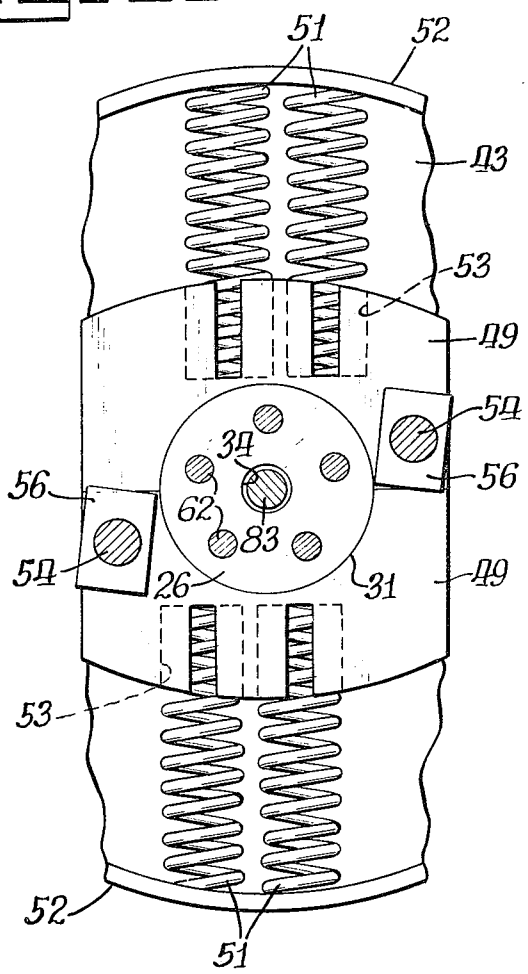
FIG. 4 is a partial view of FIG. 3 with portions deleted for illustrative convenience.
Figure 3:
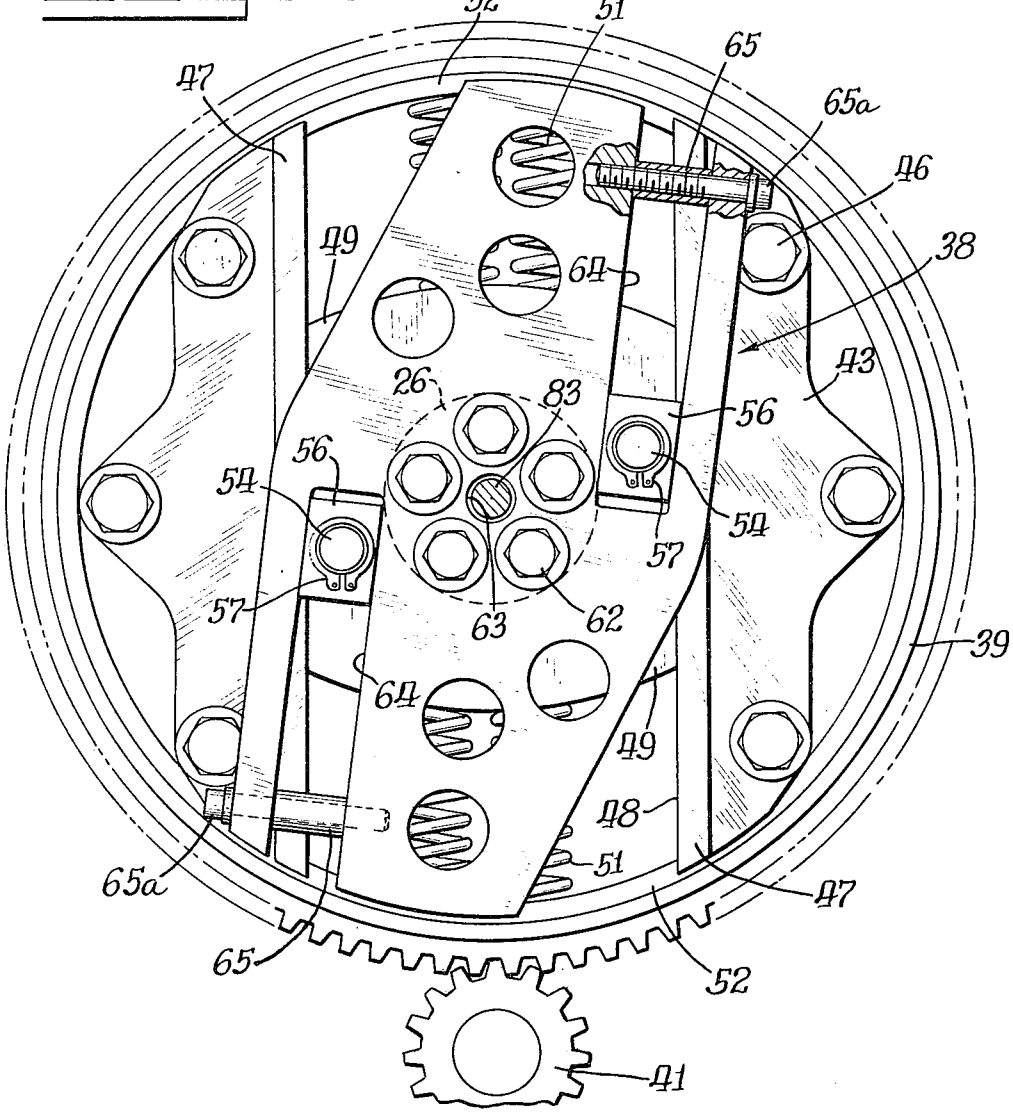
FIG. 3 is a sectional view taken generally along line III—III of FIG. 1

An elongated driving plate 61 is secured to the end of the shaft 26 adjacent to the mounting plate 14 by a plurality of bolts 62. A centrally disposed aperture 63 extends through the driving plate. A pair of cam slots 64 are formed in the driving plate and slidably receive the slider blocks 56 fastened to the flyweights. With the driving plate and flyweights in the position shown in FIGS. 3 and 4 the cam slots are positioned at a small angle relative to the guide slot. As the flyweights move radially outward in the guide slots in response to increased engine speed, the relative angular position of the driving plate and gear changes. A spacer 65 is disposed within the outer end of each slot and has a bolt **65*a*** extending therethrough to maintain a substantially constant width of the slot.

A manual timing adjustment mechanism 66 of the engine timing device 10 includes an annular sleeve 67 which is rotatably disposed in the bore 32 of the shaft 26 and is secured to an annular flange 68 by a plurality of bolts 69. The annular flange is keyed to the fuel pump actuating shaft 11 by a key 71 and is axially secured thereto by a nut 72. A pair of axially aligned bores 73 and 74 are formed in the annular sleeve. A cup shaped plug 76 is sealingly pressed into the bore 73.

A coupling member 77 is disposed within the bores 74 and 33 of the annular sleeve 67 and shaft 26, respectively. The coupling member is drivingly connected to the sleeve by a straight spline connection 78 and to the shaft by a helical spline connection 79. The coupling member has an axial bore 81 extending therethrough and a pair of counterbores 82 individually formed at its opposite ends. A tie rod 83 has an end portion 84 extending through the bore 81 of the coupling member and is rotatably secured to the coupling member by a pair of bearings 86 seated in the counterbores 82. The coupling member is axially fixed to the tie rod by a nut 87 and an annular flange 88 formed on the tie rod. The tie rod extends through the bore 34 of the shaft 26 and has a threaded portion 89 formed on its opposite end. The threaded portion is screw-threaded into the threaded bore 21 of the adapter 18 and is locked in a preselected position by a lock nut 91.

OPERATION

While the operation of the present invention is believed clearly apparent from the foregoing description, further amplification will subsequently be made in the following brief summary of such operation. The automatic timing mechanism 38 of the engine timing device 10 of the present invention is responsive to an increase in engine speed automatically to change the relative angularity between the gear 39 and the fuel pump shaft 11. More specifically, as the engine speed increases, the flyweights 49 move outwardly in the guide slots 48 due to centrifugal force. In so doing the slider blocks 56 slide within the cam slots 64 of the driving plate 61 causing the driving plate to rotate relative to the gear 39. Since the driving plate is fastened to the shaft 26 and ultimately to the fuel pump shaft 11, the net result is that the relative angularity between the gear 39 and the fuel pump shaft 11 is changed. This effectively advances the injection of fuel into the combustion chambers of the engine.

The initial angle of the slots 64 relative to the guide slot 48 is selected such that the frictional force on the slider blocks 56 against the surface of the cam slots 64 exceeds the retarding force exerted by the reverse torque generated in the pump drive shaft 11. This eliminates the tendency of the timing mechanism to be forced toward the retarded position by the torque generated in the mechanism due to the pumping action.

The manual timing mechanism 66 of the engine timing device 10 is utilized to set the initial or static timing of the engine with the engine running at low idle and the cover plate 22 removed. For setting the static timing, the lock nut 91 is backed off and the tie rod 83 is rotated resulting in axial movement of the tie rod due to its threaded connection with the adapter plate 18. The axial movement of the tie rod moves the coupling member 77 axially relative to the shaft 26 and sleeve 67. The helical spline 79 between the coupling member and shaft causes the coupling member and sleeve 67 to rotate relative to the shaft thereby permitting the static timing to be precisely set. The lock nut 91 is then jammed against the adapter 18 to lock the tie rod and thus the coupling member 77 in their selected position.

The lead angle of the helical spline connection 79 is selected to minimize the thrusting force exerted to the coupling member 77 as a result of the driving torque and also for the purpose of providing a convenient magnitude of timing change per turn of the tie rod 83.

In view of the foregoing it is readily apparent that the structure of the present invention provides an engine timing device with which the static timing of the engine can be precisely adjusted with the engine running. This is accomplished by interconnecting a driving and driven member through a coupling member which is connected to one of the members with a helical spline such that axial movement of the coupling member results in relative angular movement between the driving and driven members. This adjustment is made without effecting the automatic timing mechanism which advances the timing of the injection of fuel into the combustion chambers in response to increased engine speeds.

While the invention has been described and shown with particular reference to the preferred embodiment, it will be apparent that variations might be possible that would fall within the scope of the present invention which is not intended to be limited except as defined in the following claims.

The embodiments of the invention in which an exclusive property or privilege is claimed are defined as follows:

1. An engine timing device for adjusting the relative angular position between a fuel pump actuating shaft and a drive gear, comprising;

a housing having a threaded aperture extending therethrough;

a hollow driving member rotatably disposed within said housing and operatively associated with and driven by the drive gear;

an annular sleeve disposed in axial alignment with said hollow driving member and operatively associated with and drivingly connected to the fuel pump actuating shaft;

a coupling member axially slidably connected to said driving member and said annular sleeve;

a helical spline connecting said coupling member to the driving member to vary the relative angular position therebetween upon axial adjustment of the coupling member;

a spline connection linking the annular sleeve with the coupling member;

a tie rod extending through the hollow driving member and having opposite ends with one of said ends being rotatably fastened to the coupling member for relative rotation therebetween, a threaded portion formed on the other of said ends with the threaded portion screw threadably extending through said threaded aperture in the housing so that manually selectively rotating the tie rod relative to the housing results in axial movement of the tie rod and the coupling member relative to the hollow driving member for changing the angular position of the driving member and annular sleeve while the engine is running;

a lock nut threaded onto the threaded portion of the tie rod and having a first position in abutment with the housing for locking the tie rod in a selected rotational and axial position for maintaining the adjusted angular position of the driving member and the annular sleeve, and a second position spaced from the housing for permitting said manual rotation of the tie rod; and an automatic timing mechanism operatively drivingly connecting the drive gear to said driving member and responsive to engine speed to vary the relative angular position between the drive gear and the driving member, said automatic timing mechanism including gear means rotatably disposed on said driving member, a transverse guide slot carried by said gear means, a pair of flyweights slidably disposed in said guide slot, spring means resiliently urging said flyweights towards said driving member, a driving plate fixed to said driving member, a pair of cam slots formed in said driving plate with the relative angularity of the cam slots and guide slots being relatively small, driving pin means fastened to said flyweights and extending into said cam slots to alter the relative angular position of the gear and driving member for advancing the timing when the flyweights move outwardly in response to a speed increase.

2. An engine timing device for adjusting the relative angular position between a fuel pump actuating shaft and a drive gear comprising;

a housing;

a hollow driving member rotatably disposed within said housing and operatively associated with and driven by the drive gear;

an annular sheeve sleeve in axial alignment with said hollow driving member and operatively associated with and drivingly connected to the fuel pump actuating shaft;

a coupling member axially slidably connected both to the driving member and the annular sleeve;

a helical spline connecting the coupling member with the driving member to vary the relative angular position therebetween upon axial adjustment of the coupling member;

a spline connection linking the annular sleeve with the coupling member;

a tie rod extending through the hollow driving member and having opposite ends with one of the ends being rotatably fastened to the coupling member for relative rotation therebetween;

actuating means operatively associated with the other end of the tie rod and manually adjustable selectively to move the coupling member axially relative to the driving member for changing the relative angular position between the driving member and the annular sleeve while the engine is running; and and automatic timing mechanism operatively drivingly connecting the drive gear to said driving member and responsive to engine speed to vary the relative angular position between the drive gear and the driving member, said automatic timing mechanism including gear means rotatably disposed on said driving member, a transverse guide slot carried by said gear means, a pair of flyweights slidably disposed in said guide slot, spring means resiliently urging said flyweights toward said driving member, a driving plate fixed to said driving member, a pair of cam slots formed in said driving plate with the relative angularity of the cam slots and guide slots being relatively small, driving pin means fastened to said flyweights and extending into said cam slots to alter the relative angular position of the gear and driving member for advancing the timing when the flyweights move outwardly in response to a speed increase.

* * * * *